US007409981B2

(12) United States Patent
Coenraets

(10) Patent No.: US 7,409,981 B2
(45) Date of Patent: Aug. 12, 2008

(54) SHUTTER DEVICE WITH GUIDEWAYS

(75) Inventor: Benoit Coenraets, Brussels (BE)

(73) Assignee: Dynaco International S.A., Moorsel (BE)

( * ) Notice: Subject to any disclaimer, the term of this patent is extended or adjusted under 35 U.S.C. 154(b) by 29 days.

(21) Appl. No.: 10/498,791

(22) PCT Filed: Dec. 11, 2002

(86) PCT No.: PCT/BE02/00187

§ 371 (c)(1),
(2), (4) Date: Jun. 14, 2004

(87) PCT Pub. No.: WO03/052235

PCT Pub. Date: Jun. 26, 2003

(65) Prior Publication Data

US 2005/0178510 A1 Aug. 18, 2005

(30) Foreign Application Priority Data

Dec. 14, 2001 (BE) ..... 2001/0819

(51) Int. Cl.
*A47G 5/02* (2006.01)

(52) U.S. Cl. ..... 160/273.1; 160/194

(58) Field of Classification Search ..... 160/268.1, 160/271, 272, 277, 194, 273.1
See application file for complete search history.

(56) References Cited

U.S. PATENT DOCUMENTS 4,478,268 A * 10/1984 Palmer ..... 160/310
5,526,865 A * 6/1996 Coenraets ..... 160/272

FOREIGN PATENT DOCUMENTS

EP 0 992 650 4/2000
WO WO-01 92672 12/2001

* cited by examiner

*Primary Examiner*—Blair M. Johnson
(74) *Attorney, Agent, or Firm*—Browdy and Neimark

(57) ABSTRACT

The invention relates to a shutter device intended to close an opening, the shutter (1) being able to be moved downwards and upwards between an open position and a closed position, this shutter (1) having flexible or articulated roughly continuous lateral edges (8, 9) running with respect to guideways (10, 11) mounted on fixed supports (12) on each side of the opening, means being provided to allow a passage to be created between the guideways (10, 11) that is wider than the distance between the lateral edges (8, 9) of the shutter (1) when the latter is in the open position.

20 Claims, 6 Drawing Sheets

SHUTTER DEVICE WITH GUIDEWAYS

The invention relates to a shutter device intended to close an opening, such as a bay or a corridor, the shutter being able to be moved downwards and upwards between an open position and a closed position, this shutter having flexible roughly continuous lateral edges running with respect to roughly vertical guideways mounted on fixed supports on each side of the passage or other opening.

At the present time it is not possible to use the full width of, for example, a corridor when a shutter device is mounted in this corridor. In the known shutter device of the aforementioned type the shutter is, for example, wound around a drum provided over the passage. In order to be able to drive the drum, the latter has a central spindle on which a motor is mounted in a direct drive relationship. This motor is provided laterally to the side of the drum, which means that the drum cannot extend across the entire width of the corridor. Thus, the passage obtained between the guideways of such a device is always appreciably narrower than the width of the corridor.

When the shutter device is mounted in a bay provided in a wall, the guideways are fixed to the wall on each side of the bay. That has the disadvantage that, when the lateral edges of the shutter disengage from the guideways as a result of contact between the shutter and an obstacle, such as a vehicle for example, the lateral edges of the shutter may strike the wall near the guideways and thus become damaged.

One of the essential objects of the present invention is to present a shutter device allowing practically the entire width of a bay or of a corridor to be used as a passage when the shutter device is mounted in a bay or corridor. In addition, the shutter device, according to the invention, prevents the lateral edges of the shutter from being able to be damaged once these edges are disengaged from the guideways.

To this end, according to the invention, means are provided to allow a passage to be created between the guideways that is wider than the distance between the lateral edges of the shutter when the latter is in the open position.

According to an advantageous embodiment of the invention, when the shutter is in the open position, the distance between at least the lower part of the roughly vertical guideways is greater than the width of the shutter, the aforesaid means allowing the distance between the lower part of the guideways and the width of the shutter to be adapted to one another when the shutter is closed so that this distance and this width are approximately equal so as to be able to take up a difference in width, larger or smaller.

According to an advantageous embodiment of the invention, the guideways are flexible, at least at their upper part.

Advantageously, the guideways are mounted so as to be able to move with respect to the fixed supports. These guideways are, in particular, mounted elastically on the aforesaid fixed supports.

According to a particular embodiment of the device according to the invention, an elastic strip extends over roughly the entire height of the aforesaid passage between the supports and the guideways.

Advantageously, the shutter consists of a continuous tarpaulin comprising a roughly elastic region which extends along the length of the shutter.

Other details and particulars of the invention will become apparent from the description given hereinafter by way of non-limiting example of some particular embodiments of a shutter device according to the invention, with reference to the appended drawings.

In the various figures, the same reference numerals relate to the same elements or to elements that are analogous.

In general, the present invention relates to a shutter device collaborating with drive means, such as a drum, the spindle of which is connected to the shaft of an electric motor. The shutter, able to move downwards and upwards between, respectively, a closed position and an open position, is intended to close a bay in a wall or any opening.

The term "shutter" should be understood, in the context of the present invention, to mean any flat at least partially supple, flexible, semirigid or rigid element or any flat element with one or more stiffeners, such as a tarpaulin, a strip of plastic, a metal gauze, a trellis, a metal sheet or a metal shutter, etc.

It should, however, be noted that particular preference is afforded to flexible shutters formed, for example, of a tarpaulin. Thus, the figures relate to a shutter 1 consisting of a tarpaulin the lateral edges of which are, for example, provided with a bulge or with a succession of little rigid blocks articulated together.

Figures 1, 2, 3:
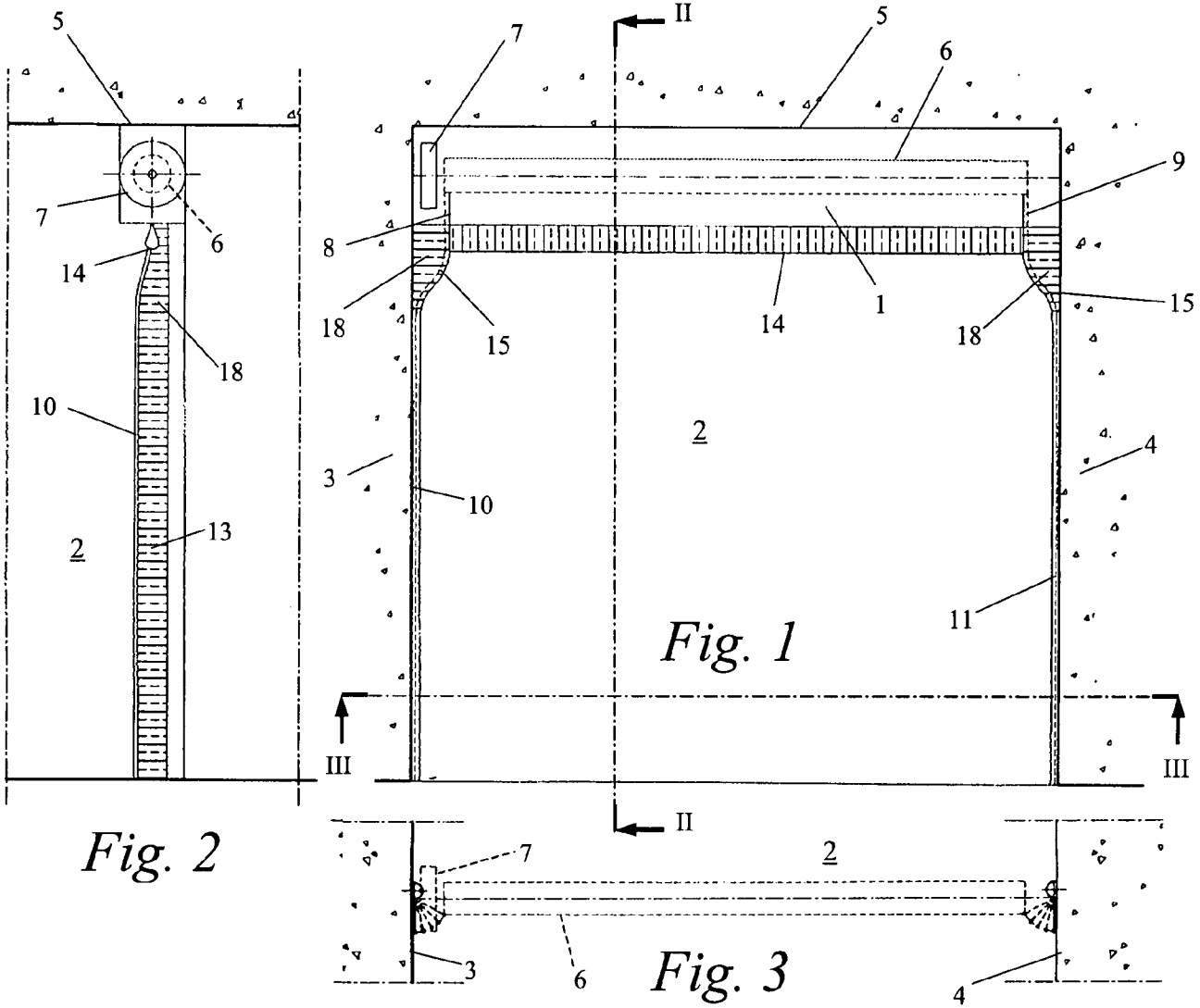
FIG. 1 is a schematic front view of a first embodiment of a shutter device in the open position according to the invention, which is mounted in a corridor.
FIG. 2 is a section on II-II of FIG. 1.
FIG. 3 is a section on III-III of FIG. 1.

FIGS. 1 to 3 show a shutter device according to a first embodiment of the invention, which is mounted in a corridor 2 between two parallel walls 3 and 4 and underneath a ceiling 5. The shutter device comprises a drum 6 depicted schematically, on which a shutter 1 is wound and which is provided on one of its sides with drive means collaborating with the drum 6. These drive means comprise an electric motor 7 in direct drive with the drum 6. The distance between the walls 3 and 4 is greater than the width of the mechanism comprising the motor 7 and the drum 6.

Figure 6:
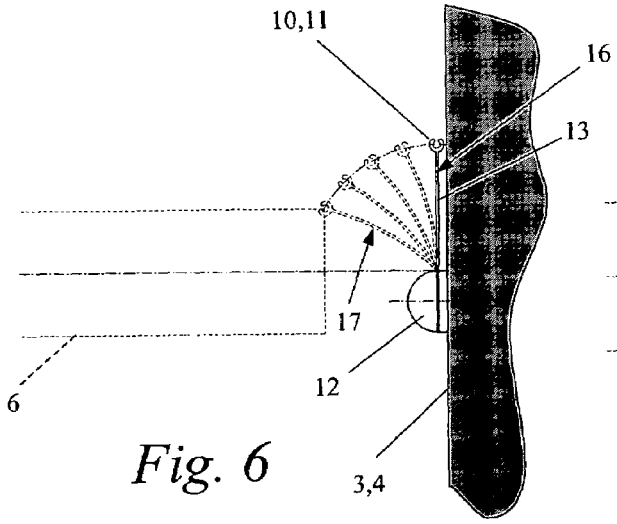
FIG. 6 is a schematic top view of a guideway of the shutter device depicted in FIGS. 1 to 5.

The lateral edges 8 and 9 of the shutter 1 are guided in roughly vertical guideways 10 and 11 mounted on the opposite walls 3 and 4 of the corridor 2. As depicted schematically in FIG. 6, the guideway 10 or 11 is fixed by means of a support 12 to the wall 3 or 4. This support 12 is formed of a bar with a semicircular cross section running vertically against the wall 3 or 4 as far as the location of the drum 6. Between the support 12 and the guideway 10 or 11 there is a continuous and flexible connecting strip 13 which extends over practically the entire length of the guideway 10 or 11. As a preference, this strip 13 is made of an elastic material such as rubber for example. When the shutter 1 is in the open position depicted in FIGS. 1 to 3, the strip 13 and the guideways 10 or 11 are folded back into a position close to the walls 3 or 4 from a certain distance from the lower edge 14 of the shutter 1 down to the bottom of the passage. Thus, the width of the passage formed between the guideways 10 and 11 corresponds roughly to the distance between the walls 3 and 4. In FIG. 6, the close-up position 16 of the guideways 10 or 11 is depicted in continuous line. In this close-up position 16, the passage formed between the guideways 10 and 11 is wider than the distance between the lateral edges 8 and 9 of the shutter 1.

In the part of the guideways 10 and 11 upstream 15 with respect to the lower edge 14 of the shutter 1, when the latter is in its open position, particularly in the upper part of the guideways, the distance between the guideways 10 and 11 corresponds approximately to the distance between the lateral edges 8 and 9 of the shutter 1. At the location of this upstream part 15, the guideways 10 and 11 hold the lateral edges 8 and 9 of the shutter 1 and find themselves in a separated position 17 with respect to the walls 3 and 4. This separated position 17 of the guideway 10 or 11 is depicted in broken line in FIG. 6.

As illustrated by FIGS. 1 and 2, because of the elasticity of the strips 13, the position of these strips 13 and of the guideways 10 and 11 varies gradually in a transition zone 18 along these guideways 10 and 11 between the separated position in the aforesaid upstream part 15 and the close-up position 16 in the downstream part of the guideways 10 and 11 with respect to the lower edge 14 of the shutter 1 when the latter is in its open position.

To this end, at least the part of the guideways 10 and 11 that is situated in this transition zone 18 is flexible.

In FIGS. 3 and 6, intermediate positions of the strip 13 and of the guideways 10 and 11 between the close-up position 16 and the separated position 17 are depicted in broken line.

Figure 5:
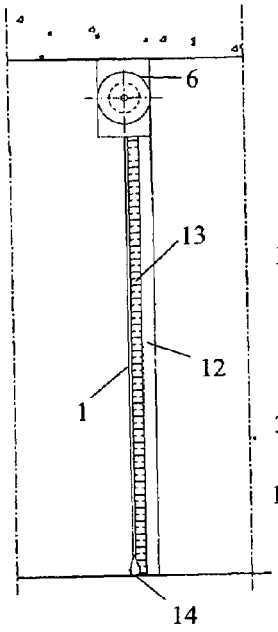
FIG. 5 is a section on V-V of FIG. 4.
Figure 4:
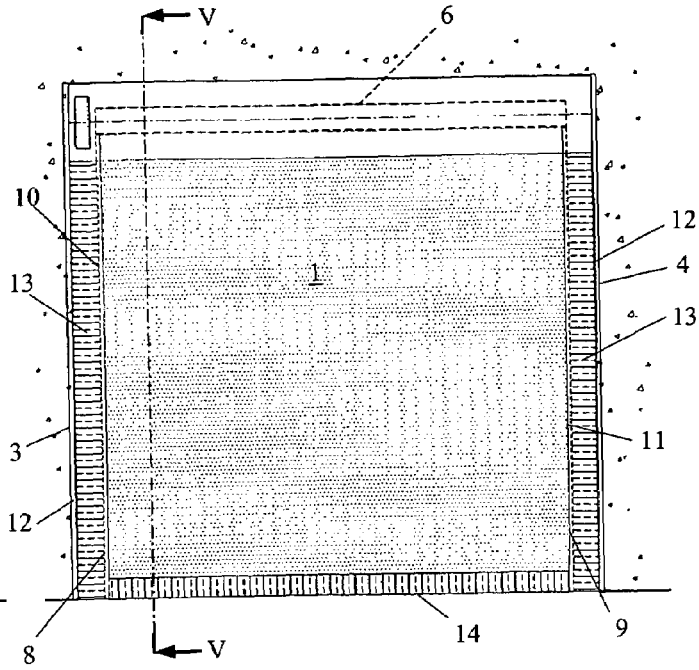
FIG. 4 is a schematic front view of the shutter device of FIG. 1 in the closed position.

As the shutter 1 runs towards its closed position, the transition zone 18 moves together with the lower edge 14 of the shutter 1 until the guideways 10 and 11 and the strip 13 are, over practically their entire length, in the separated position 17 as depicted in FIGS. 4 and 5. Thus, the distance between the downstream part of the guideways 10 and 11 is adapted to the width of the shutter 1.

In the embodiment of the shutter device according to the invention, the guideways 10 and 11 preferably form a single entity with the abovementioned strip 13.

Because of the flexibility of the guideways 10 and 11 and of the elasticity of the strip 13, it is possible to absorb any unevenness of the walls 3 or 4 to which the strip 13 is fixed by means of the support 12.

Obviously such a support 12 is not always needed. The strip 13 may, for example, be fixed directly to the walls 3 and 4 by means of simple screws in the close-up position 16 so that when the shutter 1 is in its open position, at least the lower part of the strip 13 is always folded back towards the walls 3 and 4 by virtue of its elasticity.

Figure 7:
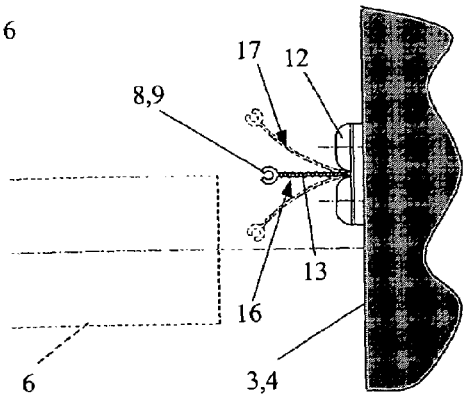
FIG. 7 is a schematic top view of one alternative embodiment of the guideway.

In another embodiment of the device according to the invention as depicted in FIG. 7, the guideway 10 or 11 is provided with an elastic strip 13 extending between a support 12 which is fixed to the wall 3 or 4 of a corridor. When the shutter 1 is in the open position, the strip 13 extends roughly transversely with respect to the wall 3 or 4 so that the edges of the shutter 1 are in a close-up position with respect to these walls 3 or 4. Since the distance between the guideways 10 and 11 is greater than the width of the shutter 1, the strip 13 is, because of its elasticity, widened under the action of the guideways 10 and 11 during the downwards movement of the shutter 1 while it is closing. Thus, the guideways 10 and 11 are moved automatically into the said separated position with respect to the walls 3 and 4 as the lateral edges 8 and 9 of the shutter 1 slide in these guideways 10 and 11.

Figure 8:
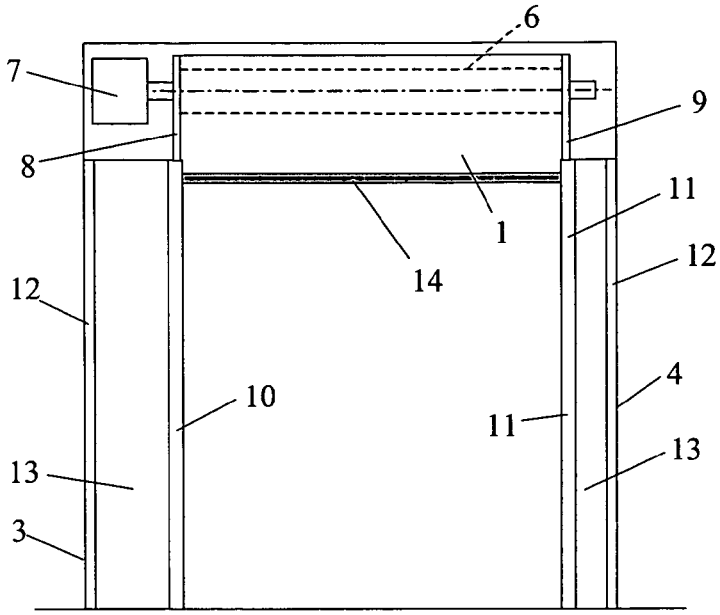
FIG. 8 is a schematic front view of a second embodiment of a shutter device in the open position according to the invention.
Figure 9:
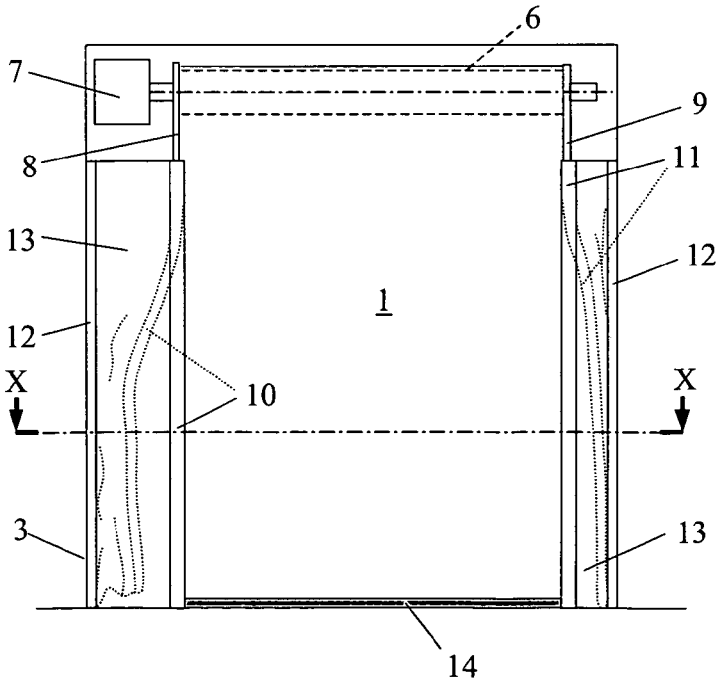
FIG. 9 is a schematic front view of the shutter device of FIG. 8 in the open position.
Figure 10:
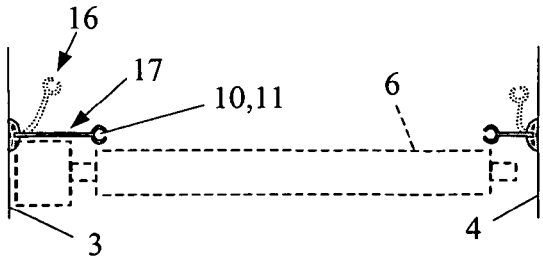
FIG. 10 is a schematic depiction of a section on X-X of FIG. 9.

FIGS. 8 to 10 depict a very advantageous embodiment of the shutter device according to the invention, which differs from the embodiment described hereinabove in that the position of the guideways 10 and 11 when the shutter 1 is in the closed position corresponds roughly to their position when the shutter 1 is in the open position. The strip 13, extending between the guideways 10 and 11 and the support 12 by means of which this strip is fixed to the walls 3 and 4, is mounted in such a way as to run roughly transversely with respect to these walls 3 and 4.

Because this strip 13 is made of an elastic material, such as rubber for example, a passage is created that has a width that can vary between the distance between the guideways 10 and 11 and the distance between the supports 12. In particular, when a vehicle passes through this passage, this vehicle may push one of the guideways 10 or 11 back, bending the strip 13, so as to open the passage. After the vehicle has passed through this passage, the strip 13 and the guideways 10 or 11 return automatically to their original position because of the elasticity of the strip 13. As a preference, the guideways are also made of an elastic or flexible material.

In FIGS. 9 and 10, the position of the strip 13 and of the guideways 10 and 11 as a vehicle passes is depicted schematically by a dotted line.

In order to prevent the lateral edges of the shutter 1 having to be reintroduced into the upper part of the guideways after the strips 13 have been flexed and folded back, means are provided for allowing the lateral edges 8 and 9 of the shutter 1 to be held in at least the upper part of the guideways 10 and 11. These means comprise, for example, a fixing of the upper part of the guideways 10 and 11 at a distance from one another which corresponds roughly to the distance between the lateral edges 8 and 9 of the shutter 1.

This embodiment has the advantage that, when the driver of a vehicle wishes to pass through the passage, he steers towards the point formed between the guideways 10 and 11, so that the probability of the vehicle striking one of the walls 3 or 4 is appreciably reduced by comparison with conventional shutter devices which have fixed guideways.

Figure 11:
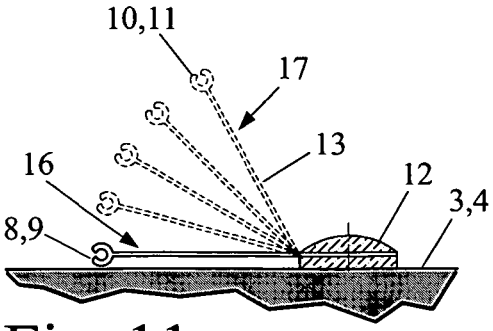
FIG. 11 is a schematic top view of a third embodiment of the guideway mounted in a corridor.

FIG. 11 depicts a third embodiment of a guideway 10 or 11 according to the invention, in which the guideway is mounted on a support 12 fixed to a wall 3 or 4 by a roughly rigid continuous strip 13 extending between this guideway 10 or 11 and the support 12. This strip 13 is articulated with respect to the support 12.

This guideway 10 or 11 collaborates, as a preference, with a pulling member, not depicted in FIG. 11, allowing this guideway to be folded over into the close-up position 16 when the shutter 1 is in the open position, the strip 13 then extending roughly parallel to the wall 3 or 4. This pulling member comprises, for example, a spring or elastic components which are provided between the guideways 10 or 11 and the support 12 or between the guideways 10 or 11 and the wall 3 or 4.

Figure 12:
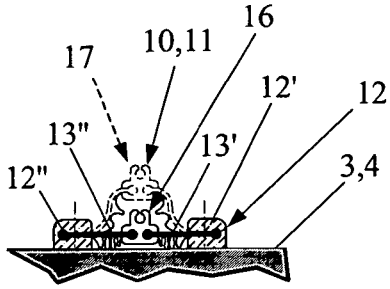
FIG. 12 is a schematic top view of a fourth embodiment of the guideway mounted in a corridor.

FIG. 12 is a schematic view of a fourth embodiment of the guideway 10 or 11. This guideway 10 or 11 can be moved between a separated position 17, depicted in broken line, and a close-up position 16, depicted in continuous line, with respect to a support 12 comprising two parallel section pieces 12' and 12" mounted a certain distance apart on the wall 3 or 4. Between the guideway 10 or 11 and each section piece 12' and 12" there are elastic components 13' and 13" so that when the shutter device is in the open position the guideway is brought close up to the wall 3 or 4 by the action of these elastic components 13' and 13". When the shutter 1, the width of which is less than the distance between the guideways 10 and 11 in their close-up position, is closed, the guideway 10 or 11 is separated from the wall 3 or 4.

Figure 13:
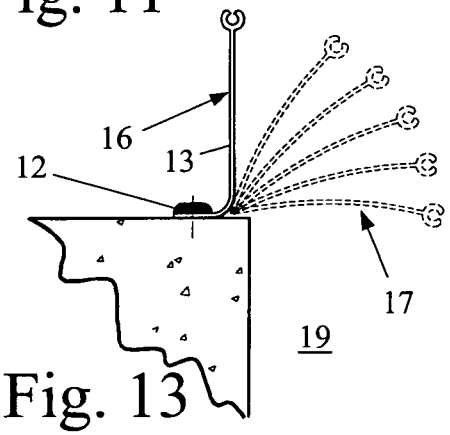
FIG. 13 is a schematic top view of a fifth embodiment of the guideway mounted against a bay.
Figure 14:
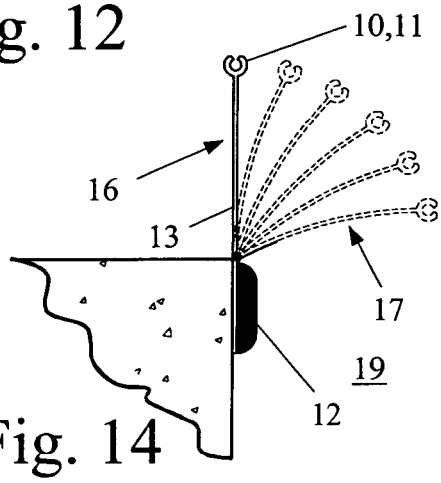
FIG. 14 is a schematic top view of a sixth embodiment of the guideway mounted in a bay.

FIGS. 13 and 14 depict a fifth and a sixth embodiment of the guideway according to the invention, in which embodiments the shutter device 1 is provided, respectively, against a bay 19 or in a bay 19. The guideways 10 and 11 are, like in the case of the guideways described hereinabove, fixed by means of a strip 13 to a support 12 attached to the wall at the location of the bay 19. This strip 13, made of an elastic and flexible material, extends, when the shutter is in the open position, roughly transversely with respect to the wall in which the bay 19 is made, so that the width of the passage between the guideways 10 and 11 corresponds roughly to the width of the bay 19.

When the shutter 1 is in the closed position, the guideways are separated from the contour of the bay 19 in the separated position, depicted in broken line in FIGS. 13 and 14.

Figure 15:
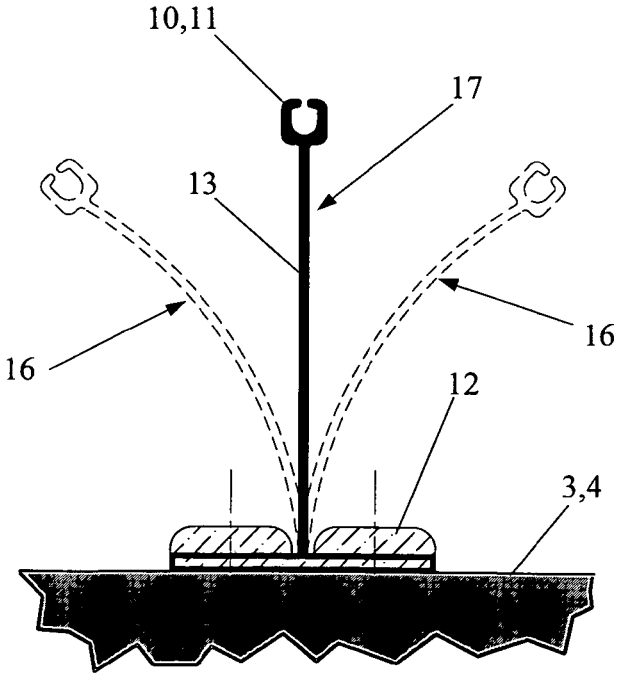
FIG. 15 is a schematic top view of a seventh embodiment of the guideway mounted in a bay.

FIG. 15 shows, on a larger scale, one of the guideways 10 or 11 of FIGS. 8 to 9. The guideway runs transversely with respect to the wall 3 or 4 in a separated position 17 with respect to this wall 3 or 4. When a vehicle passes through the passage formed between the guideways 10 and 11, folding back the elastic strip 13 provided between the guideways 10 and 11 and a support 12 fixed to the wall 3 or 4, the guideways 10 and 11 are brought into a close-up position 16, thus widening the passage between them.

Figures 16, 17, 18:
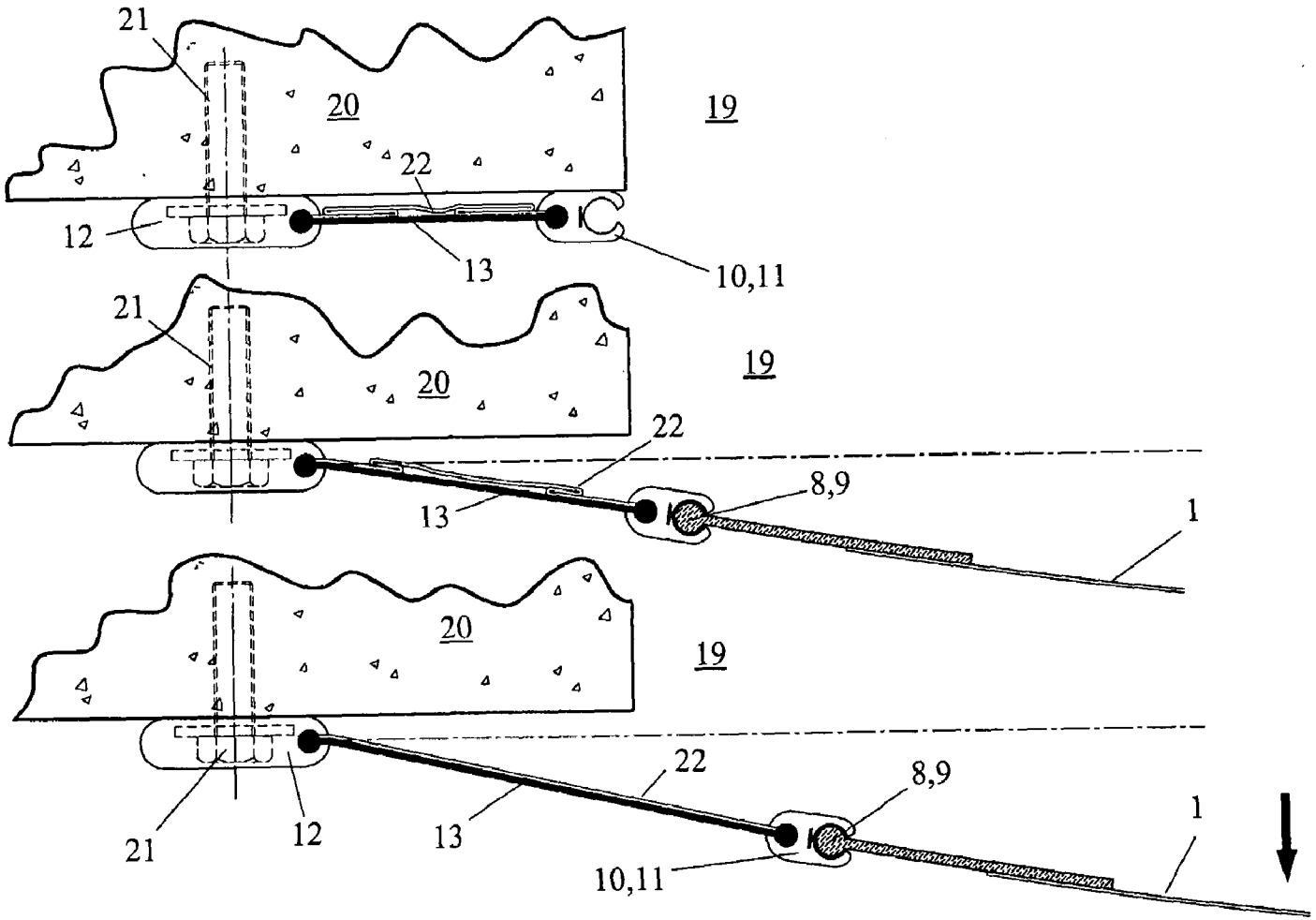
FIG. 16 is a schematic depiction of an eighth embodiment of the guideway, with the shutter in the open position, mounted against a bay.
FIG. 17 depicts the guideway of FIG. 16 with the shutter in the closed position.
FIG. 18 depicts the guideway of FIGS. 16 and 17 with the shutter in the closed position when a pushing force is exerted on the plane of the shutter.

FIGS. 16 to 18 show one side of an eighth embodiment of a shutter device mounted at the location of a bay 19. In this embodiment, a support 12 is fixed to the wall 20 along the two opposite sides of the bay by means of bolts 21. A guideway 10 or 11 running roughly parallel to this support 12 is attached to the latter by an elastic strip 13.

When the shutter 1 is in the open position as depicted in FIG. 16, the guideway 10 or 11 runs in a position close up to the wall 20 along the lateral side of the bay 19.

During the downwards movement of the shutter 1 towards its closed position, the guideways 10 and 11 are gradually moved into a separated position with respect to the wall 20, widening the strip 13. In this separated position, depicted in FIG. 17, the guideways 10 and 11 lie in front of the bay 19.

When a pushing force is exerted on the plane of the shutter 1, for example by the wind, the strip 13 is lengthened further, as depicted in FIG. 18, so as to prevent the shutter 1 from becoming disengaged from the guideways 10 or 11.

Between the guideway 10 or 11 and the corresponding support 12 there are several cords 22 to make sure that the strip 13 is not widened beyond a certain limit. The length of these cords 22 corresponds to the maximum distance over which the strip 13 can be stretched without it becoming damaged.

This embodiment is very advantageous because, during the downwards or upwards movement of the shutter 1, the guideways 10 and 11 lie facing the opening of the bay 19, which means that when a vehicle comes into contact with the shutter 1 and the lateral edges 8 and 9 thereof disengage from the guideways 10 or 11, these lateral edges 8 and 9 cannot be thrown against the wall 20 and are therefore not damaged by the effect of such violent contact with the wall 20.

It is obvious that, in order to match, on the one hand, the distance between the part of the guideways downstream of the lower edge 14 of the shutter 1 when the latter is in its open position with, on the other hand, the width of the shutter so that this distance and this width are roughly equal, it is possible for the guideways 10 and 11 to be mounted so that they are roughly fixed on a wall at the location of a bay or in a corridor. In such a case, the distance between the lateral edges 8 and 9 of the shutter 1 when the latter is in the open position is shorter than the distance between the lateral edges 8 and 9 of the shutter 1 in the closed position.

For this, the shutter 1 comprises at least one strip made of an elastic material extending continuously or discontinuously over the entire length of the shutter 1. As the shutter 1 closes, this strip is stretched gradually during the downwards movement of the shutter 1.

Advantageously, the entire shutter 1 consists of a continuous tarpaulin comprising a roughly elastic region which extends up to at least one lateral edge 8 or 9 of the shutter 1.

According to another embodiment, the shutter 1 is made of a roughly elastic material.

Figure 19:
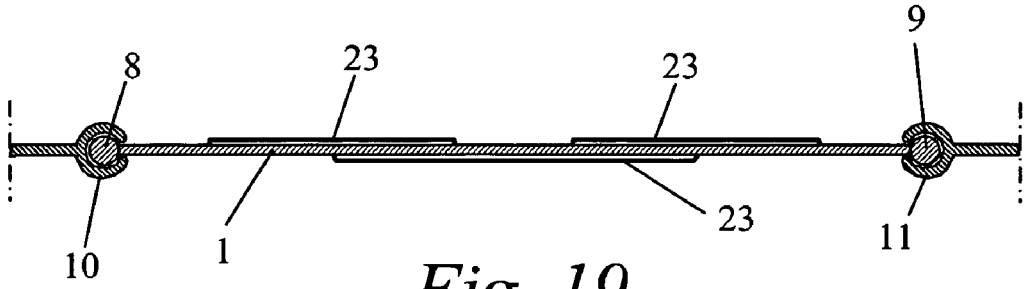
FIG. 19 is a schematic depiction of a cross section of a particular embodiment of the shutter when the latter is in the closed position.
Figure 20:
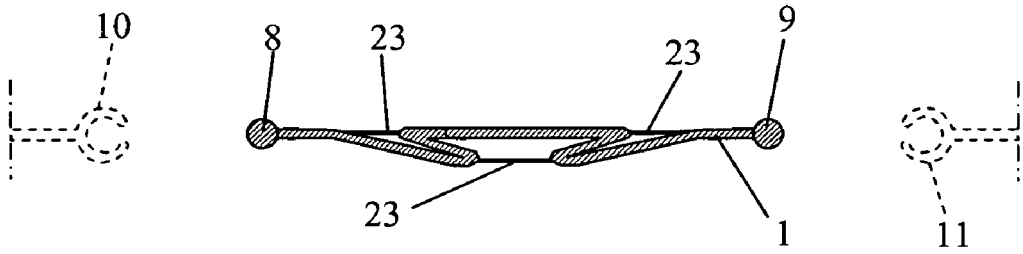
FIG. 20 is a schematic depiction of a cross section of the shutter of FIG. 19 in the open position.

In FIGS. 19 and 20, a shutter 1 is depicted which has elastic components 23 able to match the distance between the lateral edges 8 and 9 of the shutter 1. In particular, in FIG. 19, the shutter 1 is depicted with the lateral edges 8 and 9 held in fixed guideways 10 and 11 in the closed position. In this closed position, the shutter 1 is stretched between the guideways 10 and 11, in the continuation of the elastic components 23.

While the shutter 1 is being opened, the lateral edges 8 and 9 are no longer held in the guideways 10 and 11 beyond the upper part thereof. The lateral edges of this part of the shutter 1, beyond the guideways, are closer together so that the distance between the lateral edges 8 and 9 of the shutter 1 is shorter than the distance between the guideways 10 and 11, as depicted schematically in FIG. 20. The shutter 1 is then, for example, wound around a drum the width of which is shorter than the width of the passage formed between the guideways 10 and 11.

In a very advantageous embodiment of the shutter device according to the invention, the guideways 10 and 11 are mounted in slots made in the walls 3 and 4 so that when the shutter 1 is open these guideways completely enter these slots when they occupy the said close-up position. By contrast, in the closed position, the guideways extend out of these slots when they occupy the said separated position. Thus, practically all of the space between the walls 3 and 4 can be used as a passage.

Of course, the invention is not restricted to the various embodiments described hereinabove; other alternative forms yet may be envisaged without departing from the scope of the present invention, particularly as regards the mounting of the guideways.

Thus, the guideways may be connected to the support by means of a flexible tarpaulin which is substantially stretched when the guideways are in the separated position when the shutter is closed. Between the guideways and the corresponding supports, elastic components may be provided so as to return the guideways automatically to the close-up position when the shutter is open.

Whereas in the above description the lateral edges of the shutter are provided with a bulge, other means may be present for guiding the lateral edges of the shutter in the guideways. The lateral edges of the shutter may for example comprise a succession of little rigid blocks articulated together.

Furthermore, in some cases, it is possible for the guideways to be provided at the lateral edges of the shutter, while a bulge, or some other element able to slide in the guideways, is mounted on the support fixed to the aforementioned wall.

Finally, the guideways may be flexible over their entire length or just the upper part of the guideways may be flexible. When a shutter is used which has an elastic region in its longitudinal direction, the guideways may be rigid.

Obviously the application of the shutter device is not restricted to vertical doors, but many other applications are also possible, for example, such as the covering of swimming pools, awnings, shelters against the rain or the sun, canopies, etc. Thus, the guideways may extend one above the other in a vertical plane or one beside the other in a horizontal plane.

The invention claimed is:

1. Shutter device intended to close an opening, the shutter device including flexible guideways (10), fixed supports (12) on which said flexible guideways (10) are mounted on each side of the opening, and a shutter (1) being able to be moved between an open position and a closed position, said shutter (1) having lateral edges (8, 9) running in said flexible guideways (10, 11), characterized in that elastic means are provided to connect the flexible guideways to the fixed supports such that the distance between the guideways (10,11) downstream of the lower edge (14) of the shutter (1) is greater than the width of the shutter (1) when the latter is in the open position, and such that, when the shutter is moved towards the closed position, the distance between the guideways (10,11) is gradually adapted to the width of the shutter (1) in a transition zone (18) along the guideways as the lateral edges (8,9) of the shutter (1) slide in the guideways (10,11), wherein at least the part of the guideways situated in the transition zone is flexible along the longitudinal direction of the guideways.

2. Device according to claim 1, characterized in that the guideways (10,11) are mounted in an elastic manner with respect to the support (12) such that, in the open position of the shutter (1), the guideways (10,11) downstream of the lower edge (14) of the shutter (1) are in a close-up position (16) with respect to the support (12), and such that, in the closed position of the shutter (1), the guideways (10,11) are in a separated position (17) with respect to the support (12), and such that the guideways (10,11) are moving gradually towards said separated position (17) during movement of the shutter (1) towards the closed position.

3. Device according to claim 1, characterized in that the guideways (10, 11) are flexible, at least in their upstream part (15) with respect to the lower edge (14) of the shutter (1) when the latter is in the open position.

4. Device according to claim 1, characterized in that the guideways (10, 11) are mounted so as to be able to move with respect to the fixed supports (12).

5. Device according to claim 1, characterized in that the guideways (10, 11) are mounted elastically on the fixed supports (12).

6. Device according to claim 1, characterized in that the guideways (10, 11) are articulated with respect to the fixed supports (12).

7. Device according to claim 6, characterized in that the guideways (10, 11) are provided with at least one arm (13) extending between the supports (12) and the guideways (10, 11), this arm (13) being articulated with respect to the supports (12) so that it can be folded down.

8. Device according to claim 1, characterized in that the guideways (10, 11) are provided with a flexible strip (13) extending between the supports (12) and the guideways (10, 11) over substantially the entire length of the guideways (10,11).

9. Device according to claim 1, characterized in that a pulling member is provided between the supports (12) and the guideways (10, 11) allowing the guideways (10, 11) to be folded down or brought closer to the supports (12).

10. Device according to claim 1, characterized in that the shutter (1) comprises at least one strip of elastic material extending continuously or discontinuously along the entire length of the shutter (1).

11. Device according to claim 1, characterized in that the shutter (1) consists of a continuous tarpaulin comprising a roughly elastic region which extends near to at least one lateral edge (8, 9) of the shutter (1).

12. Device according to claim 1, characterized in that practically the entire shutter (1) is made of a roughly elastic material.

13. Device according to claim 1, characterized in that the ends (15) of the guideways (10, 11) upstream of the lower edge of the shutter (1), when the latter is in the open position, are mounted a fixed distance apart which corresponds substantially to the width of the shutter (1).

14. Device according to claim 2, characterized in that the guideways (10, 11) are flexible, at least in their downstream part (16) with respect to the lower edge (14) of the shutter (1) when the latter is in the open position.

15. Device according to claim 2, characterized in that the guideways (10, 11) are mounted so as to be able to move with respect to the fixed supports (12).

16. Device according to claim 3, characterized in that the guideways (10, 11) are mounted so as to be able to move with respect to the fixed supports (12).

17. Device according to claim 14, characterized in that the guideways (10, 11) are mounted so as to be able to move with respect to the fixed supports (12).

18. Device according to claim 2, characterized in that the guideways (10, 11) are mounted elastically on the fixed supports (12).

19. Device according to claim 3, characterized in that the guideways (10, 11) are mounted elastically on the fixed supports (12).

20. Device according to claim 14, characterized in that the guideways (10, 11) are mounted elastically on the fixed supports (12).

* * * * *